US007014388B2

(12) United States Patent
Bibber

(10) Patent No.: US 7,014,388 B2
(45) Date of Patent: Mar. 21, 2006

(54) ANTI-VEHICLE SECURITY SYSTEM

(76) Inventor: Michael Van Bibber, 8647 Bluff Springs, NE., Albuquerque, NM (US) 87114

( * ) Notice: Subject to any disclaimer, the term of this patent is extended or adjusted under 35 U.S.C. 154(b) by 0 days.

(21) Appl. No.: 10/888,337

(22) Filed: Jul. 9, 2004

(65) Prior Publication Data

US 2006/0008321 A1 Jan. 12, 2006

(51) Int. Cl.
*E01F 3/12* (2006.01)

(52) U.S. Cl. ..... 404/6; 49/9; 49/34; 49/49

(58) Field of Classification Search ..... 49/9, 49/34, 49; 404/6, 9; 256/1, 13.1
See application file for complete search history.

(56) References Cited

U.S. PATENT DOCUMENTS

| | | | | | |
|---|---|---|---|---|---|
| 1,748,563 | A | * | 2/1930 | Strauss | 49/9 |
| 1,929,859 | A | * | 10/1933 | Strauss | 246/29 R |
| 2,237,106 | A | * | 4/1941 | Minert | 49/9 |
| 2,251,699 | A | * | 8/1941 | Banschbach | 49/9 |
| 2,336,483 | A | * | 12/1943 | Hoover | 49/9 |
| 2,465,936 | A | * | 3/1949 | Schultz | 244/110 R |
| 4,759,655 | A | | 7/1988 | Gorlov | |
| 4,824,282 | A | | 4/1989 | Waldecker | |
| 5,118,056 | A | * | 6/1992 | Jeanise | 246/127 |
| 5,269,623 | A | * | 12/1993 | Hanson | 404/6 |
| 5,310,277 | A | | 5/1994 | Uotila | |
| 5,624,203 | A | * | 4/1997 | Jackson et al. | 404/6 |
| 5,634,738 | A | * | 6/1997 | Jackson et al. | 404/6 |
| 5,762,443 | A | | 6/1998 | Gelfand et al. | |
| 5,823,705 | A | * | 10/1998 | Jackson et al. | 404/6 |
| 5,829,912 | A | | 11/1998 | Marcotullio et al. | |
| 5,993,104 | A | | 11/1999 | Marcotullio et al. | |
| 6,062,765 | A | | 5/2000 | Dotson | |
| 6,312,188 | B1 | | 11/2001 | Ousterhout et al. | |
| 6,485,225 | B1 | * | 11/2002 | Baker | 404/6 |
| 6,499,911 | B1 | * | 12/2002 | Hilliard et al. | 405/32 |
| 6,789,979 | B1 | * | 9/2004 | Jones | 404/6 |
| 6,843,613 | B1 | * | 1/2005 | Gelfand et al. | 404/6 |
| 2003/0235466 | A1 | | 12/2003 | Krewsun | |

* cited by examiner

*Primary Examiner*—Robert E. Pezzuto
*Assistant Examiner*—Alexandra Pechhold
(74) *Attorney, Agent, or Firm*—Ray R. Regan

(57) ABSTRACT

An anti-vehicle security system that includes a truss assembly formed with a plurality of monolithic stanchions. A container having a hinged door is fixed on the truss assembly. The system also includes two spaced-apart guides that extend from within the container to a portion of the truss assembly in ground contact. A gravitationally deployable restraining device, which may be stored in and deployed from the container, includes sleeves, clips and keepers to deploy the restraining device to snare a vehicle.

16 Claims, 6 Drawing Sheets

ANTI-VEHICLE SECURITY SYSTEM

FIELD OF TECHNOLOGY

The apparatus and method disclosed in this document pertain generally to security. More particularly, the new and useful anti-vehicle security system claimed in this document pertains to an device for restraining vehicular entry into a prohibited area. The anti-vehicle security system is particularly, but not exclusively, useful for prohibiting vehicular entry without causing either the death of vehicle occupants, or destruction of the vehicle.

BACKGROUND

An international need has arisen to block vehicular entry into prohibited areas. At least one subcategory of achieving that goal includes blocking selected vehicular entry without injury either to the occupants or to the vehicle. Vehicular restraining apparatus thus far suggested by others include complicated devices whose sophistication may render such apparatus nonfunctional precisely when needed. For example, restraining devices have been proposed that require propulsion systems for raising structural components, components that may not propel when needed. Similarly, telescoping supports and arms may not telescope when operation is desired. Other vehicle inhibitors call for frangible materials in a variety of components that must be replaced after each use, a limitation in remote areas. Accordingly, need exists in the industry for the new, useful, simple to install, and simple to operate anti-vehicle security system disclosed and claimed in this document.

SUMMARY

The anti-vehicle security system disclosed and claimed in this document includes a truss assembly formed with a plurality of monolithic stanchions. A container having a hinged door is fixed on the truss assembly. The system also includes two spaced-apart guides that extend from within the container to a portion of the truss assembly that is in ground contact. A gravitationally deployable restraining device, stored in and deployed from the container, includes sleeves, clips and keepers to deploy the restraining device to snare a vehicle.

The term "gravitationally deployable restraining device," as used in this document, includes at least non-frangible open-meshed fabrics, nets, barriers, meshed materials, and sheets of material. The term "gravitationally deployable restraining device" also includes at least one cable intertwined with the gravitationally deployable restraining device. In one embodiment of the anti-vehicle security system, ends of the cable are connectable to two spaced-apart guides.

It will become apparent to one skilled in the art that the claimed subject matter as a whole, including the structure of the apparatus, and the cooperation of the elements of the apparatus, combine to result in a number of unexpected advantages and utilities. The structure and co-operation of structure of the anti-vehicle security system claimed in this document will become apparent to those skilled in the art when read in conjunction with the following description, drawing figures, and appended claims.

The foregoing has outlined broadly the more important features of the invention to better understand the detailed description that follows, and to better understand the contributions to the art. The anti-vehicle security system claimed in this document is not limited in application to the details of construction, and to the arrangements of the components, provided in the following description or drawing figures, but is capable of other embodiments, and of being practiced and carried out in various ways. The phraseology and terminology employed in this disclosure are for purpose of description, and therefore should not be regarded as limiting. As those skilled in the art will appreciate, the conception on which this disclosure is based readily may be used as a basis for designing other structures, methods, and systems. The claims, therefore, include equivalent constructions. Further, the abstract associated with this disclosure is intended neither to define the anti-vehicle security system claimed in this document, which is measured by the claims, nor intended to limit the scope of the claims. The novel features of the anti-vehicle security system claimed in this document are best understood from the accompanying drawing figures, considered in connection with the accompanying description of the drawing, in which similar reference characters refer to similar parts, and in which:

DETAILED DESCRIPTION

Figure 1:
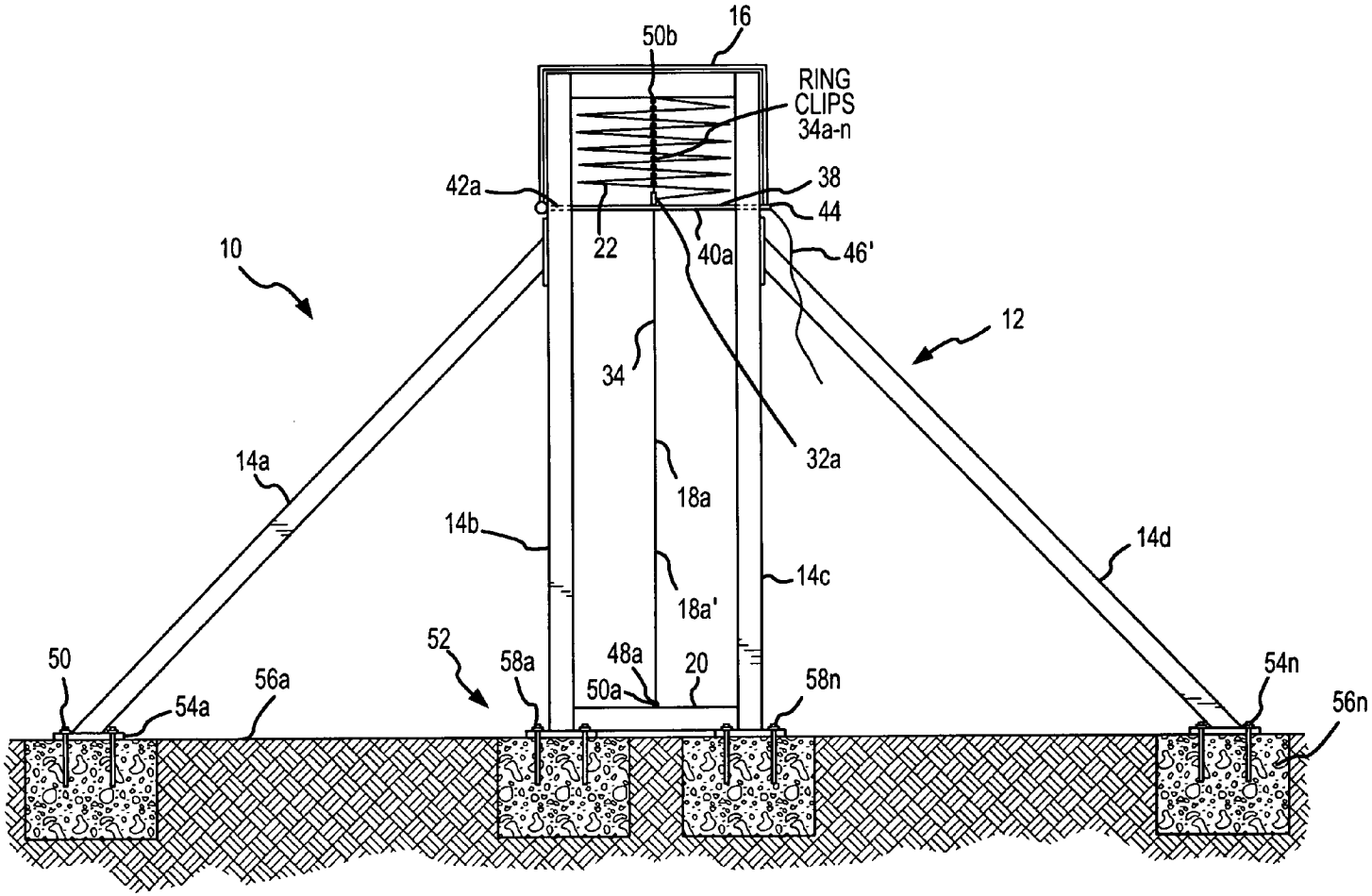
FIG. 1 of the drawing is a side view of the anti-vehicle security system.
Figure 2:
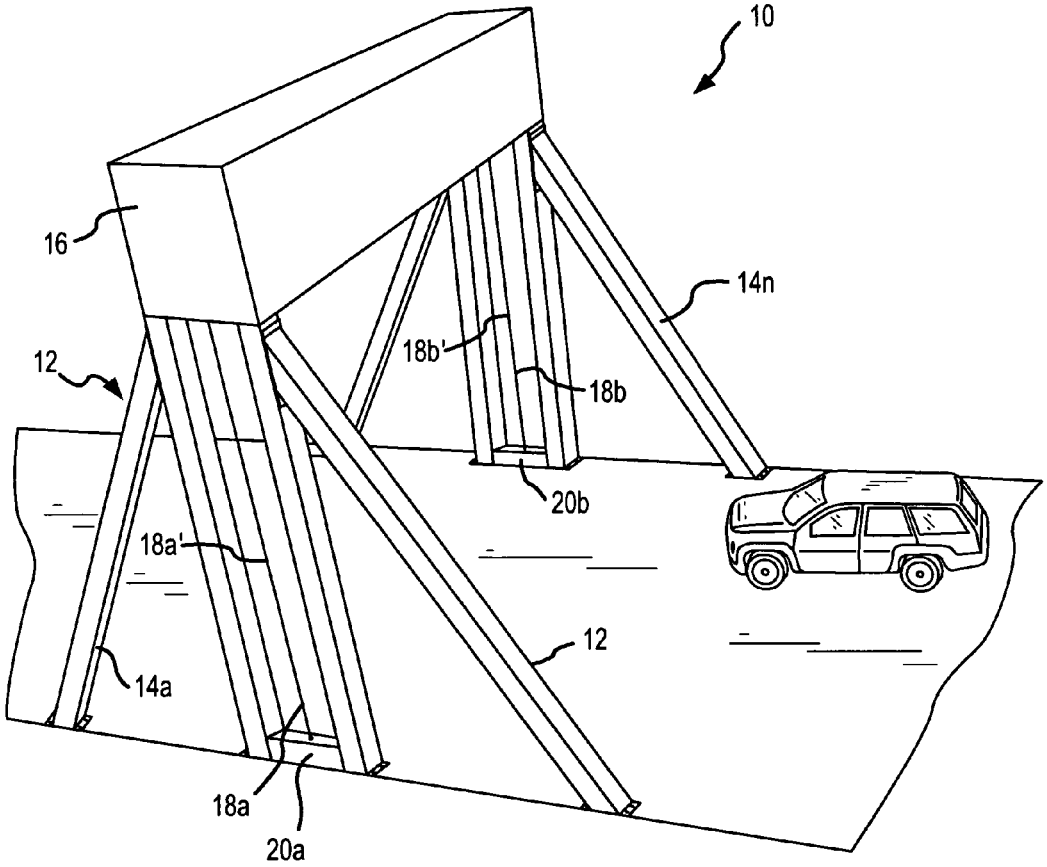
FIG. 2 is a perspective view of the anti-vehicle security system before deployment with a vehicle approaching.
Figure 3:
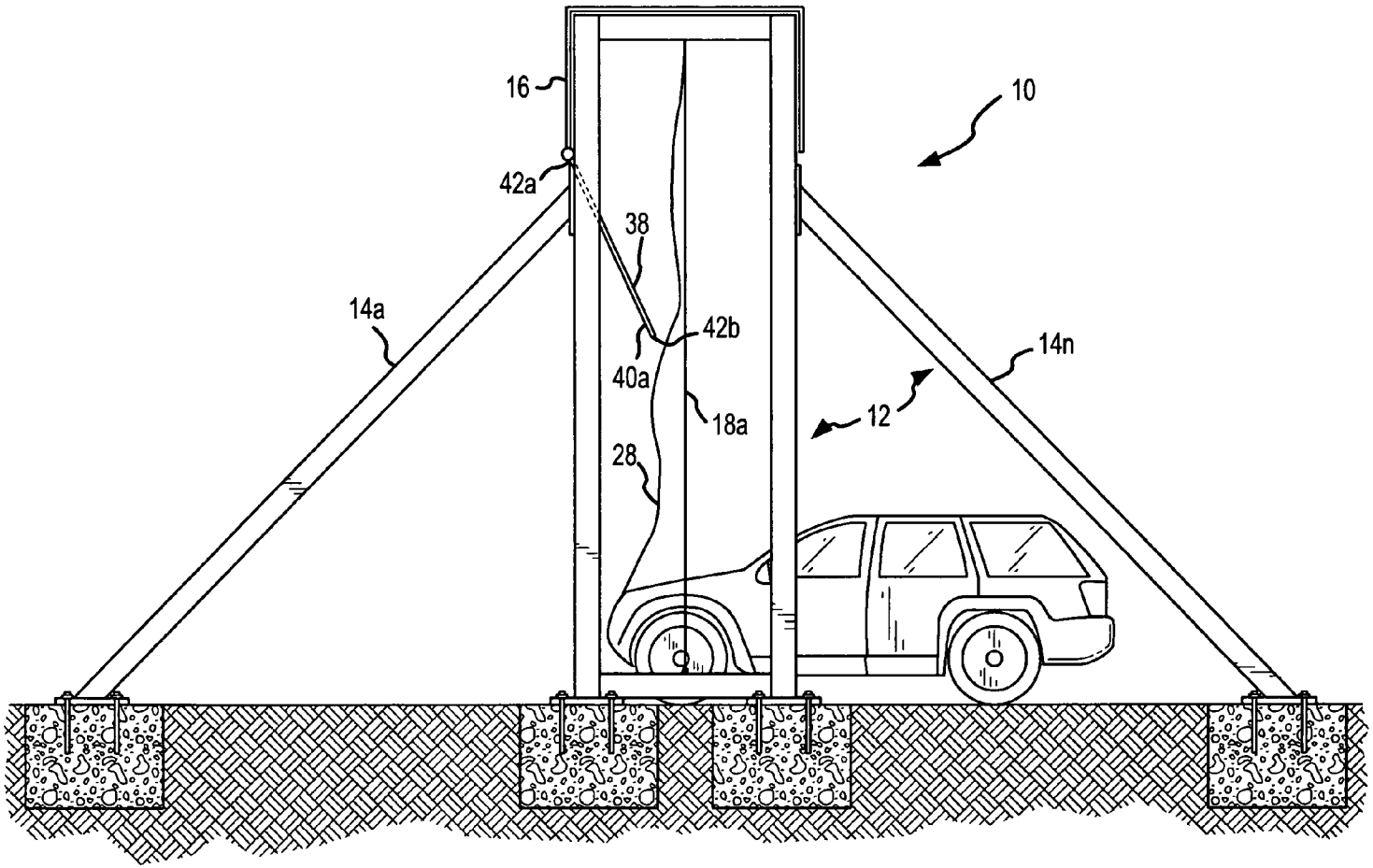
FIG. 3 is a side view of the partially deployed anti-vehicle security system without a net.

As shown in FIGS. 1–5, an anti-vehicle security system, generally designated 10, is provided that in its broadest context includes a truss assembly 12 formed with a plurality of monolithic stanchions 14; a container 16 fixed to truss assembly 12; two spaced-apart guides 18*a,b* extending from container 16 to a truss assembly member 20; a gravitationally deployable restraining device 22 that is removably insertable into container 16, and that also is connectable to two spaced-apart guides 18*a,b*; and also includes means 24 for deploying gravitationally deployable restraining device 22.

Anti-vehicle security system 10 includes no motor, no hydraulic apparatus, and no devices operable by alternating current.

The term "gravitationally deployable restraining device," as used in this document, includes non-frangible open-meshed fabrics, nets, barriers, meshed materials, and sheets of material, generally designated 26, and referred to in this document for ease of reference as a "net." The term "gravitationally deployable restraining device" also includes at least one cable 28 intertwined with gravitationally deployable restraining device 22. As shown by cross-reference between FIGS. 4B and 5, net 26' is non-frangible.

Figure 4A:
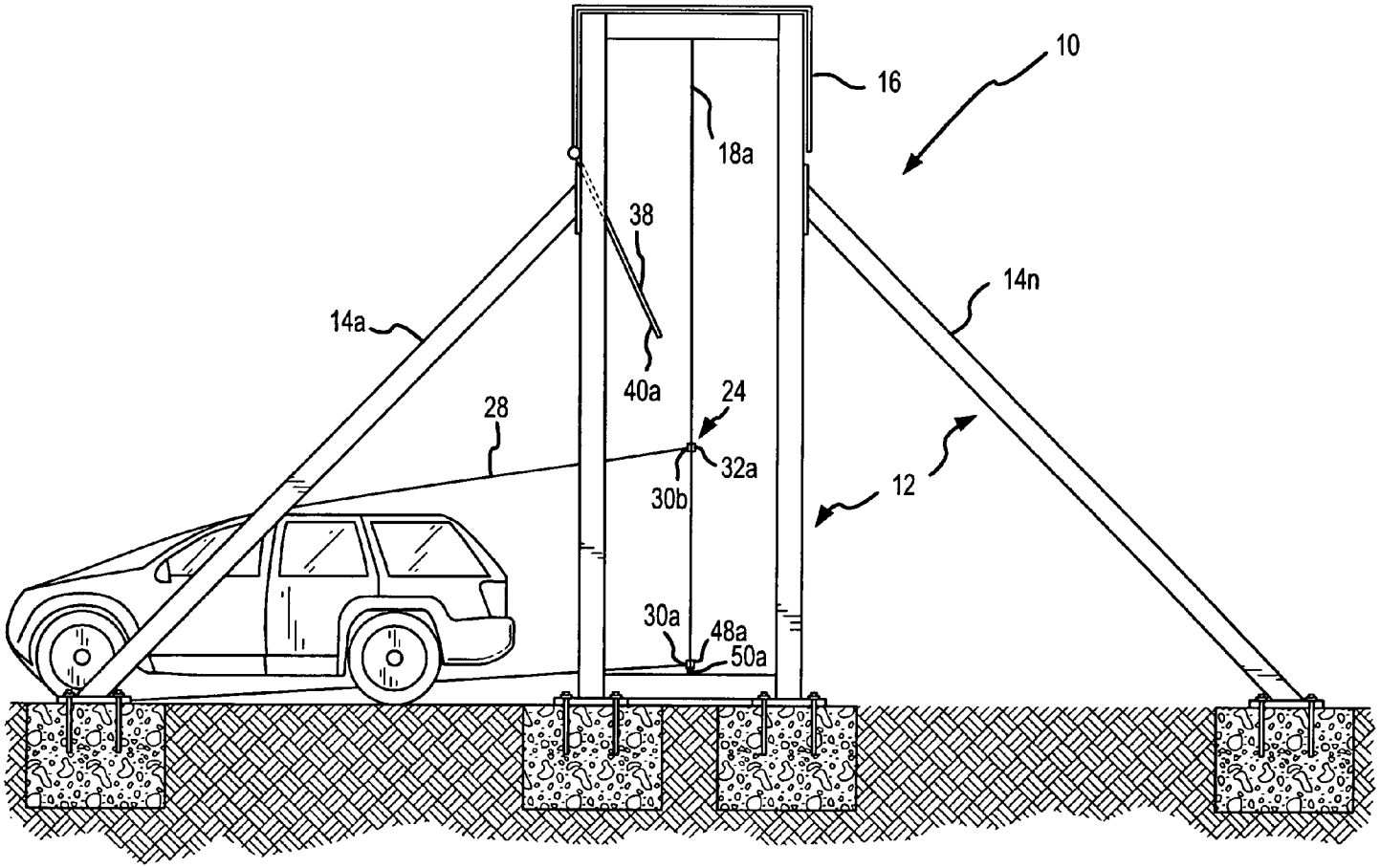
FIG. 4A is a side view showing a vehicle caught by the net of the anti-vehicle security system.
Figure 4B:
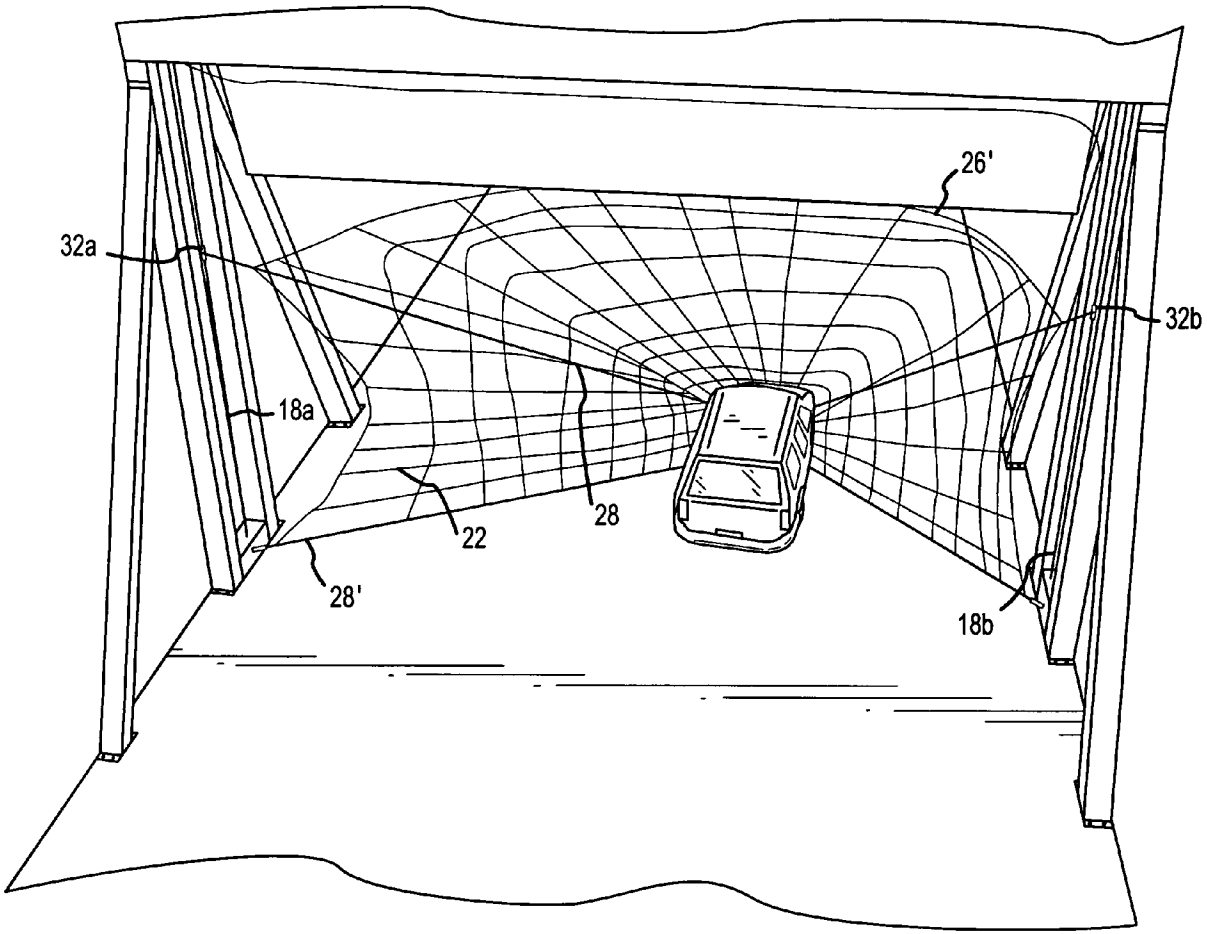
FIG. 4B is a perspective view showing a vehicle caught by the anti-vehicle security system.
Figure 5:
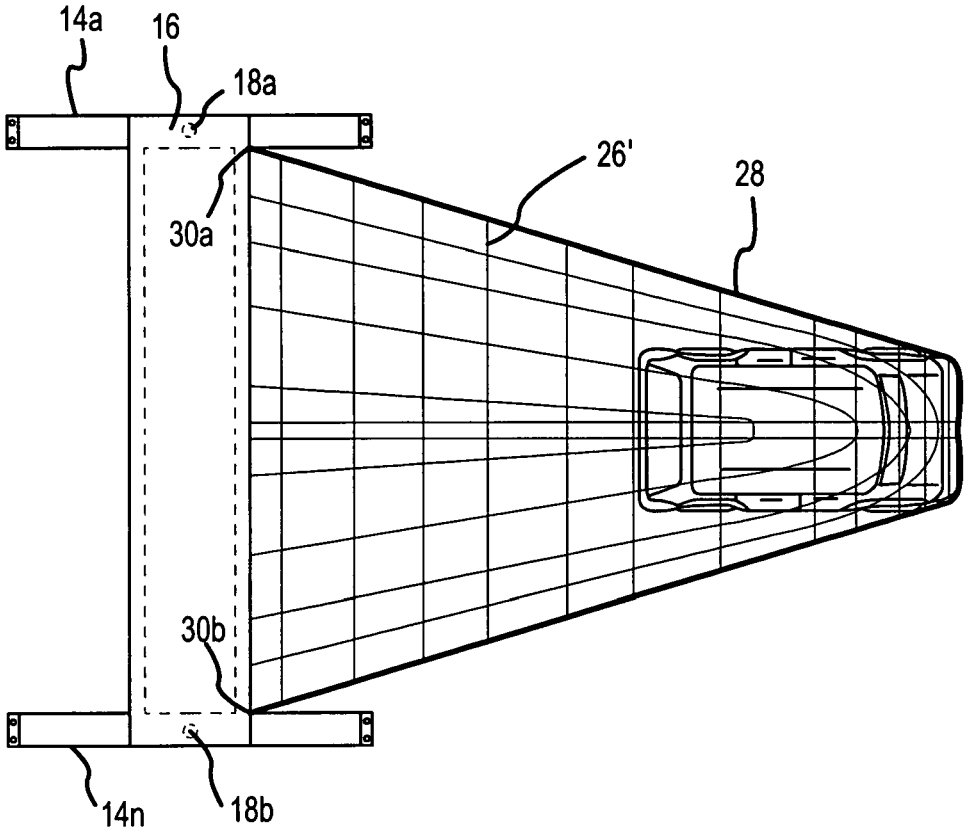
FIG. 5 is a top view showing a vehicle caught by the anti-vehicle security system.

In one embodiment of anti-vehicle security system 10, as shown by cross-reference between FIGS. 4A and 5, opposing ends 30*a,b* of cable 28 are connectable to two spaced-apart guides 18*a,b*. As perhaps best shown in the embodiment shown in FIGS. 1 and 3, spaced-apart guides 18*a,b* may be formed from cables 18*a*' and 18*b*'. In one embodiment of anti-vehicle security system 10, as shown in FIGS. 1 and 4A, one or more sleeves 32*a,b* are provided. One or more sleeves 32*a,b* are connected to opposing ends 30*a,b* of cable 28 of gravitationally deployable restraining device 22. One or more sleeves 32*a,b* also are slideably mountable on two spaced-apart guides 18*a,b*. One or more sleeves 32*a,b* are weighted sufficiently to employ the force of gravity to remove the deployable restraining device 22 from the container 16 on opening of container 16.

As shown in FIG. 1, means 24 for deploying gravitationally deployable restraining device 22 also includes a plurality of ring clips 34*a–n*. Ring clips 34*a–n* are attachably detachable to gravitationally deployable restraining device 22. Ring clips 34*a–n* also are slideably engageable with the outer surface 34 of two spaced-apart guides 18*a,b*. As a person skilled in the art will appreciate, ring clips 34*a–n* may be selected from clips like parachute release clips used for connecting a military parachute to a static line. Ring clips 34*a–n* may be salvageable or of the break-away type.

In another embodiment of anti-vehicle security system 10, as perhaps best shown in FIGS. 1, means 24 for deploying gravitationally deployable restraining device 22 also includes a door 38. Door 38 is rotatably mounted on container 16. Door 38 includes opposing sides 40*a,b* (40*b* not shown) and opposing edges 42*a,b*. In one embodiment of anti-vehicle security system 10, opposing edge 42*a* is rotatably mounted on container 16 using a hinge assembly comparable to a piano hinge (not shown in detail). In another embodiment, door 38 is dimensioned along the longitudinal axis parallel to opposing edges 42*a,b* to be less than the dimension of container 16 to allow space for spaced-apart guides 18*a,b* to extend through a space (not shown) between opposing sides 40*a,b* and container 16. At least one latch 44 is included. Latch 44 may be attached to any number of means 46 for releasing latch 44. In one embodiment, as shown in FIG. 1, means 46 for releasing latch 44 is a lanyard 44' extending from latch 44 to an operator of anti-vehicle security system 10. In another embodiment of anti-vehicle security system 10, means 46 for releasing latch 44 is a sensor-controlled remote control unit operated by battery (not shown).

As also shown by cross-reference between FIGS. 1 and 4A, anti-vehicle security system 10 includes in one embodiment a keeper 48. Keepers 48*a,b* are fixed to lower extremities 50*a,b* of two spaced-apart guides 18*a,b*. As shown, the term "lower" means in a direction opposite door 38 of container 16. Keepers 48*a,b* also are fixed to opposing ends 30*a,b* of cable 28.

As perhaps best shown in FIG. 1, anti-vehicle security system 10 includes in one embodiment means 52 for securing the anti-vehicle security system at a selected site. As shown, in one embodiment means 52 for securing the anti-vehicle security system at a selected site includes footer plates 54*a–n*. Footer plates 54*a–n* may be affixed to footings 56*a–n* as shown in FIG. 1. As will be evident to one skilled in the art, footer plates 54*a–n* may be affixed to footings 56*a–n* using any of a number of connectors well known in the art, including nuts and bolts 58*a–n*.

Operation

In operation, as shown by cross-reference between FIGS. 1–5, anti-vehicle security system, generally designated 10, is secured at the entrance to a site into which vehicular traffic is prohibited. Footings 56*a–n* are formed from a material such a concrete, cured, and any of a number of connectors 58*a–n* are used to secure footer plates 54*a–n* to footings 56*a–n*, thus installing monolithic stanchions 14*a–n* of truss assembly 12 at a desired location. Container 16, with its rotatable door 38, has been mounted on truss assembly 12 as shown perhaps best in FIG. 1.

Restraining device 22 is attached to clips 34*a–n* that in turn are slidably mounted on spaced-apart guides 18*a,b*, as perhaps best shown in FIG. 4A. As indicated, restraining device 22 includes cable 28, opposing ends 30*a,b* of which are attached respectively to sleeves 32*a–b* and to keepers 48*a,b*. Much as one would pack a parachute, restraining device 22 may be packed into container 16. Door 38 is closed after restraining device 22 is packed into container 16, and latch 44 is secured.

Means 46, such as lanyard 46', is attached to latch 44. The other end of lanyard 46' is provided to an operator who is monitoring the secure site. When a suspicious vehicle seeks entry into the secure site, the operator may simply pull lanyard 46'. Door 38 swings open, and gravity pulls restraining device 22 from container 16. Gravity acts on sleeves 32*a,b* and on cable 28. In addition, opposing ends 30*a,b* of cable 28 are anchored to keepers 48*a,b* so that, in combination, cable 28 in restraining device 22 wraps around the motor vehicle A to preclude entry. Because none of the components need be frangible, restraining device 22 can be repacked and refolded into container 16 for reuse.

The anti-vehicle security system claimed in this document shows at least one embodiment in drawing FIGS. 1–5, but is not intended to be exclusive, but merely illustrative of the disclosed but non-exclusive embodiments. Claim elements and steps in this document have been numbered and/or lettered solely as an aid in readability and understanding. Claim elements and steps have been numbered solely as an aid in readability and understanding. The numbering is not intended to, and should not be considered as intending to, indicate the ordering of elements and steps in the claims. Means-plus-function clauses in the claims are intended to cover the structures described as performing the recited function that include not only structural equivalents, but also equivalent structures. Thus, although a nail and screw may not be structural equivalents, in the environment of the subject matter of this document a nail and a screw may be equivalent structures.

What is claimed is:

1. An anti-vehicle security system, comprising:

a truss assembly formed with a plurality of monolithic stanchions;

a container fixed to the truss assembly;

two spaced-apart guides extending from the container to a truss assembly member;

a gravitationally deployable restraining device removably insertable into the container and connectable to the two spaced-apart guides; and means for deploying the gravitationally deployable restraining device that includes no motor, no hydraulic apparatus, and no devices operable by alternating current.

2. An anti-vehicle security system as recited in claim 1, wherein the gravitationally deployable restraining device is selected from the group of gravitationally deployable restraining devices consisting of open-meshed fabrics, nets, barriers, meshed material, and sheets of material.

3. An anti-vehicle security system as recited in claim 2, wherein the gravitationally deployable restraining device further comprises at least one non-frangible intertwined cable connectable to the one or more guides.

4. An anti-vehicle security system as recited in claim 1, wherein the deploying means includes a plurality of ring clips attachable to the gravitationally deployable restraining device and slideably engageable with the two spaced-apart guides.

5. An anti-vehicle security system as recited in claim 4, wherein the deploying means includes one or more sleeves couplable to the gravitationally deployable restraining device and slideably mountable on the two spaced-apart guides.

6. An anti-vehicle security system as recited in claim 5, wherein the deploying means further comprises a door rotatably mounted on the container.

7. An anti-vehicle security system as recited in claim 6, wherein the one or more sleeves is weighted sufficiently to gravitationally remove the deployable restraining device from the container on opening of the door.

8. An anti-vehicle security system as recited in claim 7, wherein the deploying means includes a mechanical construct for opening and closing the trap door.

9. An anti-vehicle security system as recited in claim 8, wherein the deploying means includes a direct current remote control unit for opening and closing the container.

10. An anti-vehicle security system as recited in claim 3 further comprising a keeper fixed to the ends of the two spaced-apart guides opposite the container and to at least one end of the intertwined cable.

11. An anti-vehicle security system as recited in claim 1, further comprising means for securing the anti-vehicle security system at a selected site.

12. A method for inhibiting vehicle movement, comprising:

forming a truss having a plurality of stanchions;

installing a container on the truss;

connecting a door movably to the container;

using material to shape a restraining device for inhibiting vehicular movement;

including one or more guides extending substantially vertically from opposing inner ends of the container; and providing means for deploying the restraining device from the container.

13. A method for inhibiting vehicle movement as recited in claim 12, wherein the truss forming step includes the substeps of:

monolithically forming the plurality of stanchions;

connecting the stanchions to form the truss;

forming footer plates fixedly attached to the ends of the plurality of stanchions adjacent a site for installing the truss; and providing connectors for fixing the footer plates at the site, wherein the connectors are selected from the group of connectors consisting of nails, rivets, screws, staples, nuts and bolts embedded in footings.

14. A method for inhibiting vehicle movement as recited in claim 12, wherein the material using step includes the substeps of:

shaping the material into a net;

or shaping the material into a sheet; and inserting a cable into the net or sheet.

15. A method for inhibiting vehicle movement as recited in claim 12, wherein the one or more guides including step includes the substeps of:

shaping the one or more guides for slideably mounting the restraining device on the one or more guides;

slideably inserting one or more sleeves on the one or more guides; and fixing a keeper at opposing ends of the one or more guides to secure the one or more guides to the truss.

16. A method for inhibiting vehicle movement as recited in claim 12, wherein the deploying means providing step includes the substeps of;

including a latch for closing and opening the door; and providing means for operating the latch.

* * * * *

UNITED STATES PATENT AND TRADEMARK OFFICE

CERTIFICATE OF CORRECTION

PATENT NO. : 7,014,388 B2 
DATED : March 21, 2006
INVENTOR(S) : Michael Van Bibber It is certified that error appears in the above-identified patent and that said Letters Patent is hereby corrected as shown below:

Title page,
Item [12], change "Bibber" to read -- Van Bibber --.

Signed and Sealed this

Twenty-third Day of May, 2006

JON W. DUDAS
*Director of the United States Patent and Trademark Office*